United States Patent [19]

Agrawal et al.

[11] Patent Number: 4,867,805

[45] Date of Patent: Sep. 19, 1989

[54] SUPERPLASTIC ALUMINUM ALLOYS, ALLOY PROCESSES AND COMPONENT PART FORMATIONS THEREOF

[76] Inventors: Suphal P. Agrawal, 3415 Coolheights Dr., Rancho Palos Verdes, Calif. 90274; Bennie R. Ward, 1200 Apex Rd., Richmond, Va. 23235

[21] Appl. No.: 151,869

[22] Filed: Feb. 3, 1988

[51] Int. Cl.[4] ..... C22F 1/04

[52] U.S. Cl. ..... 148/11.5 A; 148/437; 148/438; 148/439; 148/440; 420/902

[58] Field of Search ..... 148/11.5 A, 2, 415–418, 148/437–440, 12.7 A; 420/902

[56] References Cited

U.S. PATENT DOCUMENTS 4,486,244 12/1984 Ward et al. ..... 420/902

*Primary Examiner*—R. Dean

*Attorney, Agent, or Firm*—Terry J. Anderson; Robert B. Block

[57] ABSTRACT

Improved superplastic aluminum alloys are formulated to contain less than 0.05 weight percent each of iron and silicon based on the total weight of the superplastic aluminum alloy. Advantageously these two elements are present at levels of 0.03 weight percent or below, preferably 0.01 weight percent or below. Advantageous superplastic forming properties are achieved with these low iron, low silicon alloys. Further advantageous superplastic forming properties are achieved by subjecting aluminum alloys to a thermomechanical treatment followed by a rapid recrystallization-anneal treatment as, for instance, a recrystallization-anneal treatment utilizing a molten salt bath. When these formulations and processes are practiced alone, in combination with each other or together with cavitation supression improvements in superplastic forming of component parts are achieved.

27 Claims, 3 Drawing Sheets

TRUE STRESS VS. TRUE STRAIN RATE FOR 7475 ALLOY VARIANTS IN UNIAXIAL TENSION

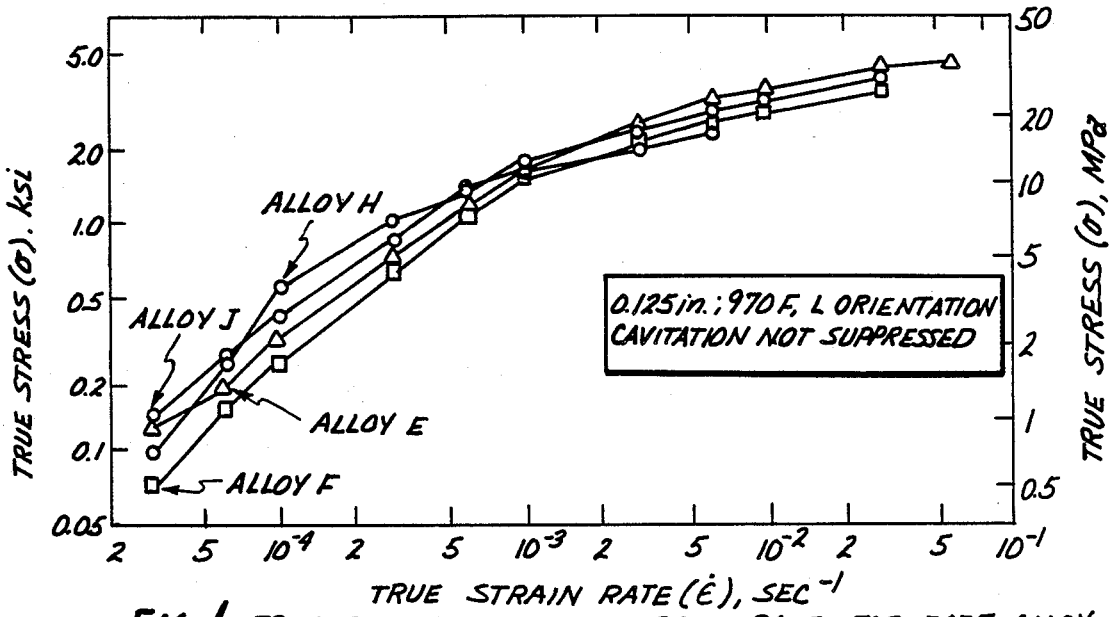
FIG. 1 TRUE STRESS VS. TRUE STRAIN RATE FOR 7475 ALLOY VARIANTS IN UNIAXIAL TENSION
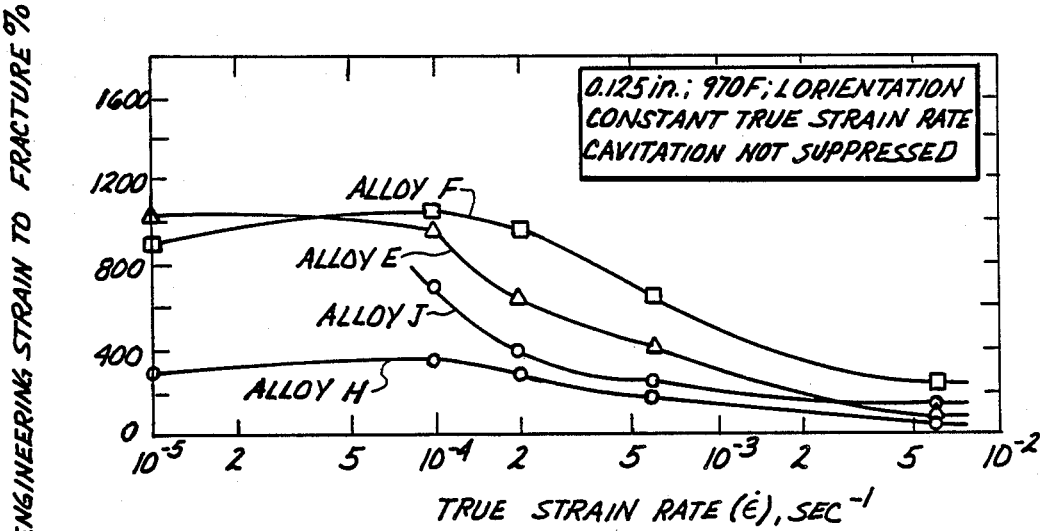
FIG. 2 SPF STRAIN TO FRACTURE VS. STRAIN RATE FOR 7475 ALLOY VARIANT IN UNIAXIAL TENSION

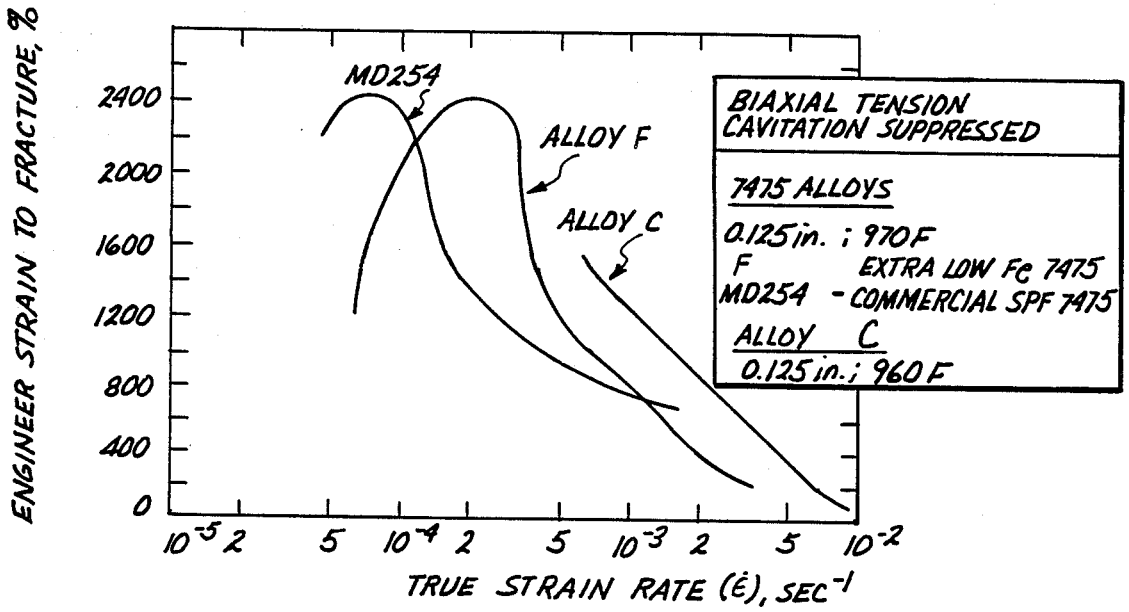
FIG. 3 SPF STRAIN TO FRACTURE VS. STRAIN RATE FOR I/M AND P/M 7000 ALLOYS
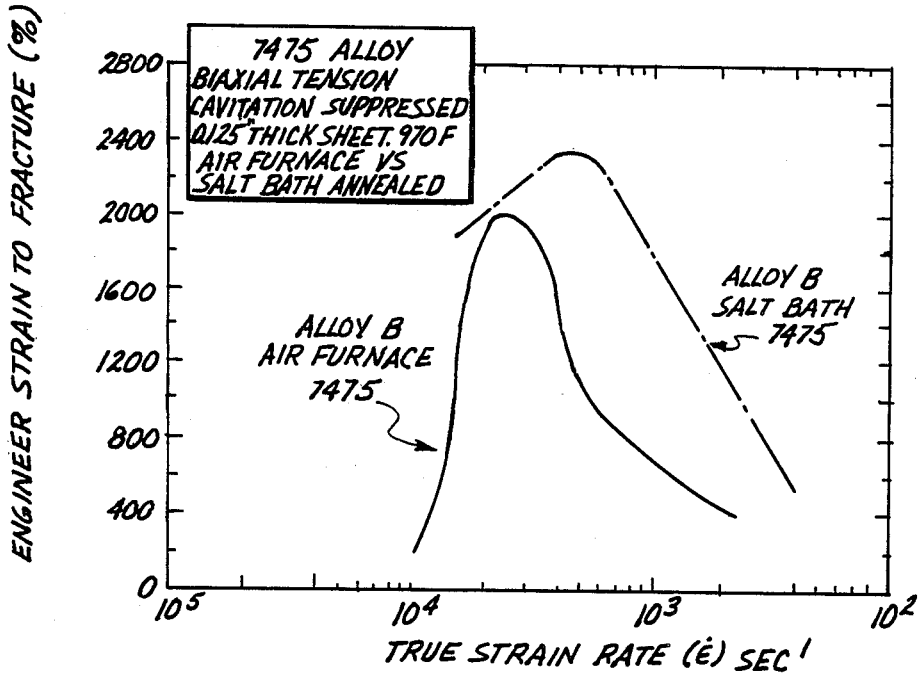
FIG. 4 ENGINEER STRAIN TO FRACTURE VS TRUE STRAIN RATE DATA FOR AIR FURNACE AND SALT BATH ANNEALED 7475 ALLOY TESTED IN BIAXIAL TENSION AT 970 F

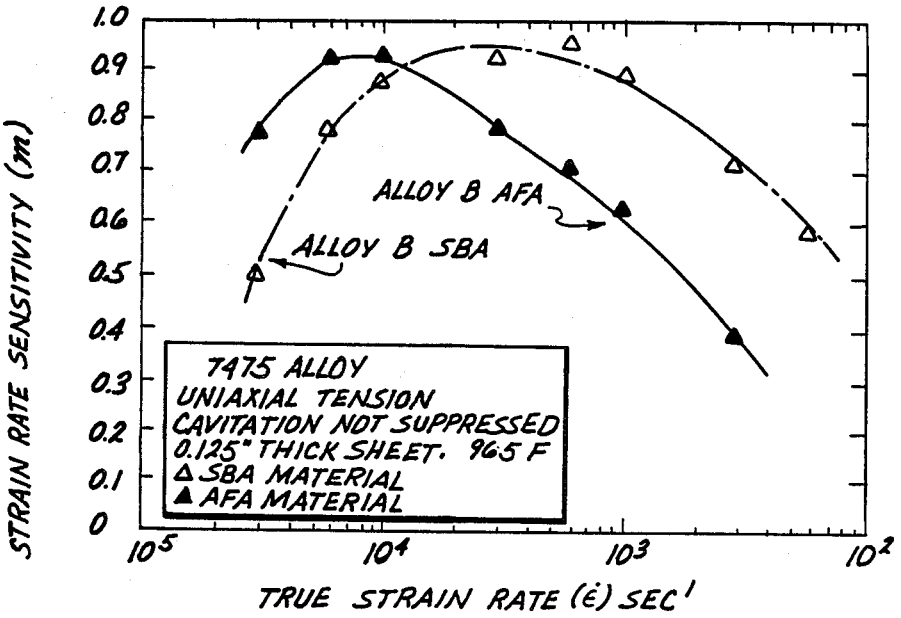
FIG. 5 STRAIN RATE SENSITIVITY (m) VS TRUE STRAIN RATE DATA FOR THE AIR FURNACE ANNEALED (AFA) AND SALT BATH ANNEALED (SBA) 7475 ALLOY TESTED IN UNIAXIAL TENSION AT 965 F
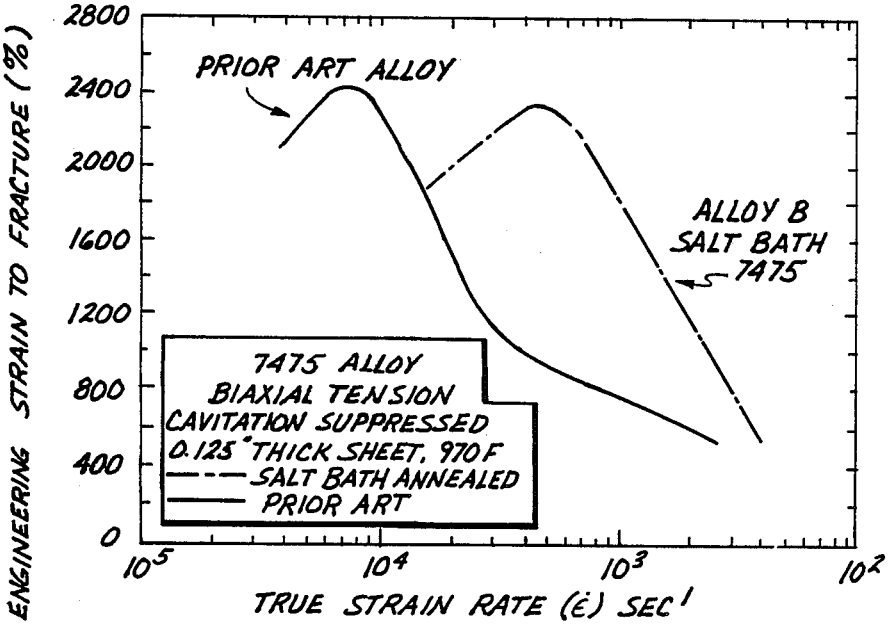
FIG. 6 ENGINEERING STRAIN TO FRACTURE VS TRUE STRAIN RATE DATA FOR PRIOR ART AND SALT BATH ANNEALED LOW Fe-Si ALLOY VARIANTS OF 7475 TESTED IN BIAXIAL TENSION AT 970 F

SUPERPLASTIC ALUMINUM ALLOYS, ALLOY PROCESSES AND COMPONENT PART FORMATIONS THEREOF

BACKGROUND OF INVENTION

This invention is directed to improved superplastic aluminum alloys and process for forming improved superplastic aluminum alloys. The improved alloys and processes are utilized alone, together or further with cavity suppression during superplastic forming of component parts.

Superplastic forming initially utilized for titanium alloys has recently been adapted for use on aluminum alloys. Since high strength aluminum alloys are used extensively in airframes the application of superplastic forming technology to aluminum alloys is expected to be very beneficial for aircraft construction.

Initial explorations of superplastic forming of aluminum alloys have resulted in certain thermomechanical treatments which have yielded improvments in the microstructure of certain off the shelf conventional aluminum alloys. This has resulted in aluminum alloys having decreased flow stress, high m values and large elongations at reasonable strain rates. A method of producing superplastic aluminum alloy sheets having improved properties is disclosed in U.S. Pat. No. 4,486,244 to Ward et al.

As opposed to titanium alloys, aluminum alloys are susceptible to cavitation during superplastic forming. U.S. Pat. No. 4,516,419 to Agrawal describes a method of controlling cavitation during superplastic forming by utilizing differential pressure between a cap side and a cavity side of a die utilized in the superplastic forming process.

While both of the above processes have led to improvements in properties of the superplastic aluminum alloys or improvements in control of the superplastic forming process, because of the large potential scale of use of superplastic forming of aluminum alloys further improvements are deemed necessary to improve both the alloys and the forming processes such that greater material properties can be achieved and/or better controlled forming processing can be practiced to increase yields, reduce costs and/or to increase the inherent properties of the components produced utilizing superplastic forming technology.

BRIEF SUMMARY OF THE INVENTION

In view of the above it is a broad object of this invention to provide for improved superplastic aluminum alloys and for processes for forming superplastic aluminum alloys. It is a further object of this invention to provide for superplastic aluminum alloys which exhibit inherent improved properties during the formation of component parts utilizing superplastic forming such that these components can be more expeditiously formed and/or the components have improved structural properties.

Achievement of these and other objects as will be evident from the remainder of this specification can be advantageously accomplished by providing improved superplastic aluminum alloys which include an aluminum matrix having a plurality of alloy elements distributed in the matrix. The plurality of alloy elements includes iron in an amount less than 0.05 weight percent of the total weight of the superplastic aluminum alloy and silicon also in an amount of less than 0.05 weight percent of the total weight of the aluminum alloy. Advantageously both iron and silicon will be present in amounts less than 0.03 weight percent of the total weight of the alloy and even more advantageously iron and silicon will be present in amounts of less that 0.01 weight percent of the total weight of the aluminum alloy.

The aluminum alloys can be formed utilizing both ingot metal technology and powder metal technology. Particularly advantageous series 7XXX aluminum alloys are formed from both ingot metal and powder metal technology. Additionally, particularly advantageous series 2XXX aluminum alloys are also formed. In all of these series of aluminum alloys as well as other potential series of aluminum alloys contributing to improved alloy properties is the presence of both iron and silicon at the levels indicated above in conjunction with other alloy elements which are present in the individual alloy series in amounts characteristics of the series.

Further, advantageously a process of forming superplastic aluminum alloys includes alloying aluminum to an alloy composition to form a base material where the alloy composition contains iron and silicon in weight percentage amounts of less than 0.05 percent respectively based on the total weight of the superplastic aluminum alloy. This base material is then subjected to thermomechanical treatment to induce nucleation sites in the base material. The stressed base material is then recrystallized and annealed to yield a small-grained improved superplastic aluminum alloy.

Moreover, improved properties are imparted to the superplastic aluminum alloys by conducting the recrystallization annealing treatment extremely rapidly as for instance from about 10 seconds to about 5 minutes, more advantageously from about 10 seconds to about 2 minutes. This can advantageously be achieved by utilizing a molten salt bath to heat the aluminum alloy. The extreme rapid temperature rise during the rapid recrystallization-anneal treatment achieves extremely fine grain structure in the aluminum matrix material and other improved properties such as improved shape and dispersements of dispersoids of the alloying elements in the aluminum matrix.

Superplastic aluminum alloys formed by utilizing one or the other of a low iron, low silicon content or an extremely rapid recrystallization-anneal treatment have improved properties with respect to prior known superplastic aluminum alloys. Superplastic aluminum alloys having even further highly improved properties can be achieved by utilizing a combination of the low iron, low silicon alloying composition in conjunction with the extremely rapid recrystallization-annealing treatment.

When the improved superplastic aluminum alloys of the invention are utilized in a superplastic forming process to form an aluminum alloy component part further improvements can be achieved by combining one or both of low iron, low silicon alloying element percentages and the rapid recrystallization-annealing treatment with cavity suppression techniques such as variable pressure superplastic component forming.

BRIEF DESCRIPTION OF THE DRAWINGS

This invention will be better understood when taken in conjunction with the drawings wherein:

FIGS. 1, 2, 3, 4, 5 and 6 are diagrams illustrating certain mechanical properties of aluminum alloys of the inventions as plotted against other mechanical properties of these aluminum alloys.

DETAILED DESCRIPTION OF THE INVENTION

U.S. Pat. No. 4,233,831 to Hamilton and Weisert generally describes a method of superplastic forming of components. For brevity of this specification the entire contents of that patent are herein incorporated by reference as to their teachings of the superplastic process and certain parameters related thereto.

U.S. Pat. No. 4,486,244 to Ward et al. describes a method of using superplastic aluminum sheet wherein the sheet is subjected to certain thermomechanical processes and then recrystallized. Further, for brevity of this specification the entire contents of that patent are also incorporated by reference with respect to their teachings of thermomechanical treatment of aluminum alloys for the formation of aluminum alloy sheet suitable for use in aluminum alloy superplastic forming.

U.S. Pat. No. 4,516,419 to Agrawal describes a method of alleviating cavitation during superplastic forming of aluminum alloys. Further, for brevity's sake in this specification the entire contents of that patent are also incorporated by reference with respect to their teachings of cavity alleviation during superplastic forming of component parts from superplastic aluminum alloy sheets.

As will be indicated in greater detail hereinafter, superplastic aluminum alloys prepared as per the teachings of this invention are characterized utilizing certain test parameters. These include both uniaxial tensile tests and biaxial testing procedures. Reference is made to the above referred to U.S. Pat. No. 4,486,244 to Ward et al. with respect to a discussion of testing procedures for the biaxial testing parameters.

Because of its light weight aluminum is a metal of choice for many different uses. Extremely pure aluminum, however, is a very weak material. In order to take advantage of the light weight of aluminum it is alloyed with certain alloying metals and nonmetals to induce strength. A variety of aluminum alloys are known. Certain of these have been found useful for forming component aluminum alloy parts utilizing superplastic forming processes.

Aluminum alloys are generally prepared utilizing one of two primary methods. The first of these is ingot technology and the second is powder metal technology. In ingot technology a melt of aluminum and the alloying elements are cast into ingots followed by cooling. For superplastic aluminum alloys, the ingots are subjected to subsequent treatments for increasing the superplasticity of the aluminum alloy as is generally discussed in the above referred to U.S. Pat. No. 4,486,244.

According to the teachings of this invention, in forming superplastic aluminum alloys from powder metal, the powder metal is first consolidated into billets and these are then further treated utilizing thermomechanical treatment to form aluminum sheets.

Utilizing these two processes representative examples of aluminum alloy series have been prepared which have exhibited superplastic forming properties. These include a 7XXX series of alloys which are illustrated utilizing both ingot and powder metal technology, a 2XXX series of alloys which are particularly useful when component parts must be joined by welding and the like.

The chemistries, i.e. the alloy formulations, of different aluminum alloys have been developed for imparting particular properties to the alloy and component parts formed therefrom. For superplastic forming one member of the 7XXX series of alloys, 7475 based alloys have been found particularly useful.

The alloying elements change the characteristics of the aluminum matrix by influencing its properties as, for instance grain size, grain structure, strength, and the like.

For superplastic forming of component parts certain general properties are sought in the material which will be superplastically formed. These include the ability to be elongated and thinned without necking. Further, the material should exhibit the property of wiping out its previous history such that it remains stable in a new conformation after being superplastically formed to that conformation. For aluminum alloys the alloy material should also resist cavitation.

During superplastic forming the grains of the base material move with respect to one another and assume new conformations with respect to each other. The creation and maintenance of fine equiaxed grain structure is sought to maximize the superplastic properties of the material and to minimize cavitation during superplastic forming.

In cooling an aluminum alloy melt, certain particles, hereinafter referred to primary or constituent particles, are first to form. As the melt further cools, the matrix material and other particles solidify. The last to solidify are certain particles referred to as precipitates. During subsequent treatment of the alloy material the precipitates can generally be brought back into solution, however, the primary particles, because of their high melting temperature cannot without resorting to a complete remelt of the total aluminum alloy.

It has been found that during superplastic forming the presence of particles at grain boundaries or triple points induces cavitation in aluminum alloys. The presence of these particles causes localized areas of stress concentration which can lead to cavitation and deformation and rupture of the material during superplastic forming.

Generally the above referred to primary or constituent particles are large and irregular in shape. During the superplastic forming process, this contributes to these particles serving as localized sites wherein stress is concentrated leading to cavitation and eventually part deformity.

In aluminum alloys generally iron and silicon in the alloy are locked together along with other elements in molecular species. As such these two elements, iron and silicon, generally have similar concentrations in the alloy. The molecular species of these two combined elements, and others, tend to form into the above referred to primary or constituent particles. Thus, once formed and unless the alloy is completely remelted, the primary particles of iron and silicon tend to remain intact.

While we do not wish to be bound by theory, it is presently believed that if the concentration of iron and silicon is at a level at or below about 0.05 weight percent, the primary or constituent particles of iron and/or iron and silicon are of the size of the order of 0.5 micrometers or smaller and are widely dispersed in the aluminum alloy. At these levels, because of their size and their wide dispersion, this significantly diminishes the effects of the primary particles as cavitation inducers. Further, while we do not wish to be bound by theory it is believed that when iron and silicon are present in the aluminum alloy at levels of from 0.03 weight percent or below preferably at levels of 0.01 weight percent or below, the effects of the primary particles formed of iron and silicon are such that cavitation induced by these particles is even more significantly inhibited.

Commercially available series 7475 aluminum alloy, which in the past has been considered particularly advantageous for use in superplastic forming processes generally has what is considered to be a "low" iron and "low" silicon content of about 0.1 percent respectively. With judicious testing and selection ingots and/or billets of this alloy might be selected which have iron and silicon levels as low as 0.07 percent. However, since ingots or billets having levels of iron and silicon at 0.07 weight percent can only be obtained by carefully gleaning them from a large number of ingots or billets having a typical 0.1 percent or greater iron or silicon content, heretofore aluminum alloys available for use for superplastic forming of aluminum components were generally considered suitable for use in superplastic forming when their iron and silicon were of the order of 0.1 weight percent.

As is discussed in the above referenced Hamilton U.S. Pat. No. 4,233,831 superplastic forming is conducted by positioning an alloy sheet over a die and utilizing fluid pressure at an elevated temperature to deform the sheet into the conformation of the die. Normally component parts which are to be superplastically formed are made in multiples in a production run. Typically, the superplastic forming machinery must be set up for the run of a particular component part and then each individual component part superplastically formed. Set up time is constant irrespective of whether one part or many parts are to be made. The times for individually forming each individual part, however, are critical to the production costs of the run of the component parts.

The material which is to be superplastically formed is strained by the fluid pressure to stretch it (elongate and/or widen it) and thin it such that it fits the conformation of a die. The rate of strain which can be applied to the material sheet which is being superplastically formed governs the process time for forming each individual component part. Typically for aluminum alloy component parts of useful geometry the rate of strain is such that forming times are normally of an order of a fraction of an hour to several hours per each individual component part. It is thus evident that in a large production run, since set up time when averaged over the totality of the number of parts being formed is small compared to the actual run time for forming the individual parts, a large percentage of the production cost of a part is directly attributable to the extended time required for fluid strain of the alloy sheet into the component part.

It has been found that by utilizing superplastic aluminum alloys of the invention having iron and silicon levels of the invention, significant increases are achieved in the strain rate which can be applied during component part formation under superplastic conditions.

By utilizing superplastic aluminum alloys having iron and silicon levels as indicated in this specification the formation time for part production can be reduced many fold as, for instance four fold or greater, such that a part which normally took an hour and a half to form by utilizing commercially available 7475 aluminum alloy can now be formed in from approximately 10 to approximately 20 minutes.

As will be evident from examples below, other properties are also imparted to the aluminum alloys as, for instance superior engineering strain to fracture, strain rate sensitivity and true stress. Particular advantageous aluminum alloys of the invention having iron and silicon levels below 0.01 weight percent have been shown to have characteristics equal to or superior to known available superplastic aluminum alloys in all of the above referred to mechanical properties criteria.

In each of the examples below, the weight percentage of aluminum in the alloys constitutes the balance or remainder of the amount not included in the table listing for the other elements given in the chemical formulations. That is:

aluminum = 100 − (total weight percent of all other elements).

EXAMPLE 1

A 7475 aluminum alloy was prepared and modified to include the low iron and low silicon content of the invention. An ingot of the alloy was cast and the chemistry of the ingot verified. Analysis of the ingot yielded the following composition:

TABLE 1

CHEMICAL COMPOSITIONS (IN WEIGHT PERCENT) OF 7475 BASED INGOT SUPERPLASTIC FORMING ALUMINUM ALLOY

Alloy A

| Si | Fe | Cu | Mn | Mg | Cr | Ni | Zn | Ti |
|---|---|---|---|---|---|---|---|---|
| 0.009 | 0.008 | 1.63 | <0.01 | 2.58 | 0.22 | <0.01 | 5.48 | 0.02 |

This ingot was then homogenized, scalped and hot rolled into a 1.5 inch slab. The slab was then subjected to a thermomechanical treatment and further rolled at a starting temperature of 625 to 650 F. into 0.125 inch sheet. This was then subjected to a recrystallization-anneal treatment in an air furnace.

EXAMPLE 2

Further aluminum alloy sheet was prepared as per Example 1 except that the chemistry was determined to be as follows:

TABLE 2

CHEMICAL COMPOSITIONS (IN WEIGHT PERCENT) OF 7475 BASED INGOT SUPERPLASTIC FORMING ALUMINUM ALLOY

Alloy B

| Si | Fe | Cu | Mn | Mg | Cr | Ni | Zn | Ti |
|---|---|---|---|---|---|---|---|---|
| <0.01 | 0.01 | 1.55 | <0.01 | 2.36 | 0.20 | <0.01 | 6.12 | 0.02 |

Alloys A and B of Examples 1 and 2 are representatives of series 7XXX ingot aluminum alloys, more specifically 7475 alloys modified to contain extra low iron and silicon.

EXAMPLE 3

A further modified 7475 aluminum alloy was prepared utilizing powder metal technology. Aluminum alloy was formed into a powdered metal in a helium atmosphere. The alloy powder was then degassed and consolidated. The consolidated powdered metal was forge rolled into a one-inch thick plate. The plate was treated with a thermomechanical treatment to 0.125 inch sheet which was subjected to a recrystallization-annealing treatment in an air furnace. This material had the following chemistry:

TABLE 3

CHEMICAL COMPOSITIONS (IN WEIGHT PERCENT) OF 7XXX BASED POWDER METAL SUPERPLASTIC FORMING ALUMINUM ALLOY*

Alloy C

| Si | Fe | Zn | Mg | Cu | Zr | Cr | Co |
|---|---|---|---|---|---|---|---|
| 0.04 | 0.03 | 7.20 | 2.32 | 1.98 | 0.39 | 0.12 | 0.20 |

*Chemical analysis obtained by ICP technique on sheets

EXAMPLE 4

In a manner similar to Example 3 a further powder metal 7XXX based alloy sheet was formed having the following chemistry:

TABLE 4

CHEMICAL COMPOSITIONS (IN WEIGHT PERCENT) OF 7475 BASED POWDER METAL SUPERPLASTIC FORMING ALUMINUM ALLOY*

Alloy D

| Si | Fe | Zn | Mg | Cu | Zr | Cr | Co |
|---|---|---|---|---|---|---|---|
| 0.02 | 0.03 | 7.09 | 2.18 | 1.87 | 0.21 | 0.10 | — |

*Chemical analysis obtained by ICP technique on sheets

EXAMPLE 5

Further 7475based superplastic forming aluminum alloys were prepared as per Example 1 having the following composition:

TABLE 5

CHEMICAL COMPOSITIONS (IN WEIGHT PERCENT) OF VARIOUS 7475-BASE SUPERPLASTIC FORMING ALUMINUM ALLOYS

Alloys E to J

| Si | Fe | Cu | Mn | Mg | Cr | Ni | Zn | Ti | Zr | |
|---|---|---|---|---|---|---|---|---|---|---|
| 0.03 | 0.05 | 1.56 | <0.01 | 2.33 | 0.20 | <0.01 | 6.12 | 0.03 | <0.01 | E |
| <0.01 | 0.01 | 1.55 | <0.01 | 2.36 | 0.20 | <0.01 | 6.12 | 0.02 | <0.01 | F |
| <0.01 | 0.01 | 1.58 | <0.01 | 2.32 | 0.36 | <0.01 | 6.04 | 0.02 | <0.01 | G |
| 0.01 | 0.02 | 1.51 | <0.01 | 2.30 | <0.01 | 0.01 | 6.08 | 0.02 | 0.20 | H |
| <0.01 | 0.01 | 1.54 | 0.51 | 2.35 | <0.01 | <0.01 | 6.03 | 0.02 | <0.01 | I |
| 0.03 | 0.05 | 1.55 | 0.21 | 2.32 | 0.21 | <0.01 | 6.12 | 0.02 | <0.01 | J |

EXAMPLE 6

A series of 2XXX aluminum alloys were further prepared. These constitute variations of 2419 aluminum alloy. The alloys were prepared following the procedures of Example 1 and exhibited the following chemistries:

TABLE 6

CHEMICAL COMPOSITIONS (IN WEIGHT PERCENT) OF VARIOUS 2419-BASE SUPERPLASTIC FORMING ALUMINUM ALLOYS

Alloys K to P

| Si | Fe | Cu | Mn | Mg | Cr | Ni | Zn | Ti | V | Zr | |
|---|---|---|---|---|---|---|---|---|---|---|---|
| 0.02 | <0.01 | 6.14 | 0.31 | <0.01 | <0.01 | <0.01 | <0.01 | 0.02 | 0.08 | 0.15 | K |
| 0.05 | 0.05 | 6.13 | <0.01 | <0.01 | <0.01 | <0.01 | 0.03 | 0.02 | 0.01 | 0.24 | L |
| 0.02 | <0.01 | 6.09 | <0.01 | <0.01 | <0.01 | <0.01 | 0.01 | 0.02 | <0.01 | 0.23 | M |
| 0.01 | <0.01 | 6.08 | <0.01 | <0.01 | 0.19 | <0.01 | <0.01 | 0.02 | <0.01 | <0.01 | N |
| 0.01 | <0.01 | 6.00 | 0.52 | <0.01 | <0.01 | <0.01 | <0.01 | 0.02 | <0.01 | <0.01 | O |
| 0.01 | <0.01 | 6.12 | <0.01 | <0.01 | <0.01 | <0.01 | <0.01 | 0.02 | 0.08 | <0.01 | P |

As noted, since iron and silicon generally tend to form molecular species in aluminum alloys a low iron alloy also is generally a low silicon alloy. While we do not wish to be bound by theory it is believed that iron content in the alloy at levels below 0.05 preferrably 0.03 and more advantageously below 0.01 will itself lead to the above improved properties noted for the alloy in the absence of concurrent reduction of the silicon level to the same level of the iron. As is evident from the chemistry of the above examples as a general premise, the iron and silicon levels in the alloys do not need to be exactly the same.

For the alloys of the invention in addition to the iron and silicon levels indicated above, series 7XXX aluminum alloys will generally have their alloying elements present at the following weight percentage levels: of about 1.0 to about 2.0 weight percent copper, of about 1.5 to about 3.0 weight percent magnesium, of about 0.2 to about 0.35 weight percent chromium, of about 5.0 to about 7.5 weight percent zinc, of about 0.01 to about 0.2 weight percent titanium, of about 0.0 to about 0.3 weight percent cobalt, of about 0.001 to about 0.3 weight percent zirconium, less than 0.01 weight percent nickel and less than 0.01 weight percent manganese respectively based on the total weight of said superplastic aluminum alloy.

Further, series 2XXX aluminum alloys will generally have their alloying elements present at the following weight percentages levels: of about 3.5 to about 7.0 weight percent copper, of about 0.01 to about 1.0 weight percent manganese, of about 0.001 to about 0.2 weight percent chromium, of about 0.001 to about 0.3 weight percent zinc, of about 0.01 to about 0.25 weight percent titanium, of about 0.001 to about 0.3 weight percent zirconium, of about 0.001 to about 0.1 weight percent vanadium, less than 0.01 weight percent nickel and from less than about 0.01 to about 2.0 weight percent magnesium respectively based on the total weight of s id superplastic aluminum alloy.

FIG. 1 illustrates properties of certain of the alloys of the invention as tested utilizing true stress versus true strain rate in uniaxial tension. For this test cavitation as hereinafter discussed in greater detail was not suppressed. As is evident from FIG. 1 an alloy having extra low iron content therein exhibited a greater strain rate at lower induced stress compared to other test alloys of the invention.

In FIG. 2 the same alloys of FIG. 1 are plotted to show their engineering strain-to-fraction percentage versus their true strain rate. For this test cavitation was also not suppressed. As is evident from FIG. 2, again the extra low iron content alloy exhibited excellent engineering strain-to-fracture characteristics at high strain rates.

FIG. 3 shows a test situation similar to that illustrated in FIG. 2 except cavitation suppression was conducted on the test sheets. For the tests of FIG. 3 biaxial tension tests as outlined in the above identified U.S. Pat. No. 4,486,244 were utilized. In FIG. 3 alloy F of Example 5 and alloy C of Example 3 were tested against a known commercial superplastic forming 7475 aluminum alloy. As is evident from FIG. 3 while the peak engineering strain-to-fracture was the same for both a low iron alloy of the invention and the commercial sample this peak engineering strain-to-fracture was achieved in an alloy of the invention at a much higher strain rate than that in the known commercial sample.

It has been further found that increased superplastic forming properties of aluminum alloys can be achieved by heating the alloys at a rate during a recrystallization-anneal prior to superplastic forming which is much greater than the rate of heating used in the art. It has been found that if the alloys are heated to a recrystallization-anneal temperature during extremely short time periods as, for instance from about 10 seconds to about 5 minutes, finer grain structure of the aluminum matrix is achieved with concurrent improved superplastic forming properties imparted in the aluminum alloy. Preferably the aluminum alloy will be heated from either ambient or the temperature of its thermomechanical treatment to the recrystallization-anneal temperature in from about 10 seconds to about 2 minutes.

After thermomechanical treatment to induce nucleation in an alloy sheet, if the alloy sheet is then heated to the recrystallization-anneal temperature within the time period of from about 10 seconds to about 5 minutes, a reduction in the grain size of the primary aluminum matrix is achieved. By heating from either an ambient thermomechanical treatment temperature or an elevated thermomechanical treatment temperature to a recrystallization-anneal temperature as, for instance a recrystallization-annealing from about 850 F. to about 1050 F. in an extremely rapid manner under 5 minutes the nucleation induced in the aluminum alloy by the thermomechanical treatment produces a large increase in the number of grains. Since the number of grains is increased and since they all compete for growth the growth of each individual grain is limited and an extremely fine grain structure is achieved. This is opposed to prior processes wherein the heating was done in an air furnace or a continuous air furnace and was much slower and as such individual grains could grow larger and consume smaller grains resulting in a very much larger grain structure. By utilizing extremely rapid heat transfer cannibalization of one grain by another is inhibited.

The rapid heating necessary for the improved recrystallization-anneal can be achieved utilizing several expedient processes. These include molten salt heating, fluidized bed heating and induction heating. The molten salt heating, however, is presently preferred because commercial molten salt baths are available which can handle large sheets of superplastic aluminum alloy as, for instance sheets from 48 to 60 inches wide and 96 to 144 or more inches long. Insofar as the recrystallization-anneal procedure is performed on the sheets and plates which generally are of a thickness no greater than 2 inches, preferredly less than 2 inches, as, for instances 1.25 inch or 0.06 inch stock, this contributes to rapid heat transfer to the sheet and plate and thus rapid recrystallization and annealing of the aluminum alloy.

Generally the recrystallization-anneal step of the aluminum alloy will be conducted from about 850 F. to about 1050 F. Preferably for 7000 series aluminum alloy the recrystallization-annealing will be conducted at from about 920 F. to about 950 F. and for 2000 series aluminum alloy the recrystallization-annealing will be conducted at from 990 F. to about 1020 F.

As noted above prior to recrystallization and anneal the aluminum alloy is subjected to a thermomechanical treatment to induce nucleation sites in the alloy. This treatment can be done at ambient temperature or at elevated temperature. It is evident that taking the extremes, that is heating from ambient temperature to the recrystallization-anneal temperature range above, that the material undergoes very rapid heating. At a minimum this rate of heating is of a rate of hundreds of degrees F. per minute.

When the rapid recrystallization-annealing process is conducted in association with low iron, low silicon chemistry, even further improved superplastic forming properties are achieved. These can be further augmented by utilizing cavitation suppression during the actual superplastic forming of a component part. Reference is made to the prior U.S. Pat. No. 4,516,419 noted above as to the actual process steps for conducting cavitation suppressed superplastic forming of component parts.

By practicing one or the other or preferably both of the low iron, low silicon chemistry and/or rapid recrystallization-annealing processes of the invention in conjunction with suppressed cavitation during the actual superplastic forming steps increases in strain rate during part formation are achieved with concurrent reduction of formation time of component parts yielding increased production rates at lower production costs.

In FIG. 4 engineering strain-to-fracture is plotted against the true strain rate for two identical 7475 aluminum alloy samples (samples of alloy B of example 2 above), one recrystallized and annealed in an air furnace as per the teachings of U.S. Pat. No. 4,269,053 noted above and the other recrystallized and annealed as per the teachings of this invention in a salt bath. As is evident from FIG. 4 a higher engineering strain-to-fracture was achieved with a salt bath treated alloy as well as achieving this higher strain-to-fracture at a higher true strain rate. In this Figure cavitation suppression as per the teachings of U.S. Pat. No. 4,516,419 above, was practiced.

In FIG. 5 the results obtained on the same materials as utilized in FIG. 4 are plotted as strain rate sensitivity (m) against true strain rate. Again it is evident that there is an increase in the strain rate, i.e. faster superplastic forming cycle times can be achieved, for the molten salt bath treated material.

In FIG. 6 a low iron, low silicon aluminum alloy of the invention is compared to a commercially available aluminum alloy utilizing engineering strain-to-fracture plotted against true strain rate. In this figure, the commercially available aluminum alloy was recrystallized and annealed at a fast rate in a continuous air furnace. The alloy B of this invention was recrystallization-annealed at a much faster rate as per a salt bath treatment of this invention, and further cavitation suppression was practiced for testing both material samples. As is evident the rapid recystallization-anneal treatment of the invention in conjunction with low iron, low silicon of the invention resulted in an increase in true strain rate.

In comparing FIGS. 2 and 3 it can be seen for the one sample, alloy F, which is included in both Figures, by practicing cavitation suppression there are increases in engineering strain-to-fracture over that wherein cavity suppression was not practiced.

It is evident that by utilizing the low iron, low silicon alloys of this invention improved superplastic alloy properties are achieved. It is also evident that by utilizing the rapid recrystallization-annealing process of this invention further improved superplastic forming properties are achieved. When either of these alone or together are utilized in conjunction with cavity suppression even further improvements in superplastic forming properties are achieved.

What is claimed is:

1. A superplastic aluminum alloy comprising:
an aluminum matrix,
a plurality of alloy elements distributed in said aluminum matrix to form an alloy base material,
said plurality of alloy elements including iron in an amount of less than 0.05 percent by weight of the total weight of said alloy base material,
said plurality of alloy elements further including silicon in an amount of less than 0.05 percent by weight of the total weight of said alloy base material,
said alloy base material exhibiting superplastic response when subjected to thermomechanical treatment followed by recrystallization-anneal treatment.

2. A superplastic aluminum alloy of claim 1 wherein:
said iron is present in an amount of less than 0.03 percent by weight of the total weight of said aluminum alloy.

3. A superplastic aluminum alloy of claim 1 wherein:
said iron and said silicon are each present in amounts less that 0.03 percent by weight of the total weight of said aluminum alloy.

4. A superplastic aluminum alloy of claim 1 wherein:
said iron and said silicon are each present in amounts less that 0.01 percent by weight of the total weight of said aluminum alloy.

5. A superplastic aluminum alloy of claim 1 wherein:
said plurality of alloy elements comprise elements chosen from the group consisting of chromium, cobalt, copper, manganese, magnesium, nickel, titanium, vanadium, zinc and zirconium.

6. A superplastic aluminum alloy of claim 5 wherein:
said superplastic aluminum alloy is a series 7XXX aluminum alloy.

7. A superplastic aluminum alloy of claim 6 wherein:
said series 7XXX aluminum alloy contains alloying elements having weight percentages of about 1.0 to about 2.0 weight percent copper, of about 1.5 to about 3.0 weight percent magnesium, of about 0.2 to about 0.35 weight percent chromium, of about 5.0 to about 7.5 weight percent zinc, of about 0.01 to about 0.2 weight percent titanium, of about 0.0 to about 0.3 weight percent cobalt, of about 0.001 to about 0.3 weight percent zirconium, less than 0.01 weight percent nickel and less than 0.01 weight percent manganese respectively based on the total weight of said superplastic aluminum alloy.

8. A superplastic aluminum alloy of claim 6 wherein:
said superplastic aluminum alloy is a series 7475 aluminum alloy.

9. A superplastic aluminum alloy of claim 5 wherein:
said superplastic aluminum alloy is a series 2XXX aluminum alloy.

10. A superplastic aluminum alloy of claim 9 wherein:
said series 2XXX aluminum alloy contains alloying elements having weight percentages of about 3.5 to about 7.0 weight percent copper, of about 0.01 to about 1.0 weight percent manganese, of about 0.001 to about 0.2 weight percent chromium, of about 0.001 to about 0.3 weight percent zinc, of about 0.01 to about 0.25 weight percent titanium, of about 0.001 to about 0.3 weight percent zirconium, of about 0.001 to about 0.1 weight percent vanadium, less than 0.01 weight percent nickel and from less than about 0.01 to about 2.0 weight percent magnesium respectively based on the total weight of said superplastic aluminum alloy.

11. A superplastic aluminum alloy of claim 9 wherein:
said superplastic aluminum alloy is a series 2419 aluminum alloy.

12. A superplastic aluminum alloy of claim 5 wherein:
said superplastic aluminum alloy is a powder metal based alloy.

13. A low iron, low silicon superplastic aluminum alloy comprising:
an amount of iron present in a concentration of less than 0.05 weight percent based on the total weight of said aluminum alloy,
an amount of silicon present in a concentration of less than 0.05 weight percent based on the total weight of said aluminum alloy,
an amount of at least one further alloy element,
an amount of aluminum comprising the balance of said aluminum alloy,
said aluminum alloy exhibiting superplastic response when subjected to thermomechanical treatment followed by recrystallization-anneal treatment.

14. A low iron low silicon superplastic aluminum alloy of claim 13 wherein:
said at least one further alloy element is chosen from the group consisting of chromium, cobalt, copper, manganese, magnesium, nickel, titanium, vanadium, zinc and zirconium.

15. A process of forming a superplastic aluminum alloy which comprises:
alloying aluminum with an alloy composition to form a base material wherein said alloy composition contains iron and silicon in weight percentage amounts of less than 0.05 weight percent respectively based on the total weight of said superplastic aluminum alloy;
subjecting said base material to a thermomechanical treatment;
subjecting said thermomechanically treated base material to a recrystallization-anneal treatment.

16. The superplastic aluminum alloy forming process of claim 15 wherein:
said alloy composition contains iron and silicon in weight percentage amounts of less than 0.03 weight percent respectively based on the total weight of said superplastic aluminum alloy.

17. The superplastic aluminum alloy forming process of claim 15 wherein:

said alloy composition contains iron and silicon in weight percentage amounts of less than 0.01 weight percent respectively based on the total weight of said superplastic aluminum alloy.

18. The superplastic aluminum alloy forming process of claim 15 wherein:

said thermomechanically treated base material is subjected to said recrystallization-anneal treatment for a time period of from about 10 seconds to about 5 minutes.

19. The superplastic aluminum alloy forming process of claim 15 wherein:

said recrystallization-anneal treatment is conducted at a temperature of from about 850 to about 1050 degrees F.

20. The superplastic aluminum alloy forming process of claim 15 wherein:

said thermomechanically treated base material is subjected to said recrystallization-anneal treatment in a molten salt bath for a time period of from about 10 seconds to about 5 minutes and at a temperature of from about 920 to about 1020 degrees F.

21. A superplastic aluminum alloy forming process which comprises:

alloying aluminum with an alloy composition to form a base material;

selecting said alloy composition to contain iron and silicon in weight percentage amounts of less than 0.05 weight percent respectively based on the total weight of said superplastic aluminum alloy;

subjecting said base material to a thermomechanical treatment;

subjecting said thermomechanically treated base material to a recrystallization-anneal treatment for a time period of from about 10 seconds to about 5 minutes at an elevated temperature.

22. The superplastic aluminum alloy forming process of claim 21 wherein:

said recrystallization-anneal treatment is conducted in a molten salt bath at a temperature of from about 850 to about 1050 degrees F.

23. An improvement in a superplastic component forming process which comprises:

alloying aluminum with an alloy composition to form a base material;

subjecting said base material to a thermomechanical treatment to form a thin sheet of aluminum alloy;

subjecting said sheet of aluminum alloy to a recrystallization-anneal treatment in a molten salt bath to form a superplastic aluminum alloy sheet blank;

superplastically forming said aluminum alloy sheet blank into said component.

24. The improvement in a superplastic component forming process of claim 23 further including:

alloying said aluminum with an alloy composition having low iron and low silicon whereby said aluminum alloy contains iron and silicon in amounts less that 0.01 percent respectively by weight of the total weight of said aluminum alloy.

25. The improvement in a superplastic component forming process of claim 23 further including:

superplastically forming said component in a die utilizing a cavitation suppression process during said forming.

26. The improvement in a superplastic component forming process of claim 23 further including:

superplastically forming said component in a die utilizing a first fluid pressure on one side of said aluminum alloy sheet blank and a second fluid pressure on the other side of said aluminum alloy sheet blank and wherein said first or second fluid pressure, or both, is a variable fluid varying at least from a high fluid pressure to a lower fluid pressure.

27. An improvement in a superplastic component forming process which comprises:

alloying aluminum with an alloy composition to form a base material;

subjecting said base material to a thermomechanical treatment;

subjecting said thermomechanically treated base material to a recrystallization-anneal treatment in a molten salt bath to form a superplastic aluminum alloy blank having improved properties;

providing a die having a cavity surface which is complementary to the shape of the component, and having fluid ports;

providing a die opposing cover having fluid ports;

providing a fluid supply for introducing fluid under pressure controllably through said fluid ports of said die and said cover;

positioning said blank between said die and said cover;

bringing said blank to a temperature at which said blank exhibits superplastic characteristics;

applying to the blank a first fluid pressure on the cavity side thereof;

simultaneously applying to said blank a second fluid pressure to the cover side thereof; and controlling said first and second fluid pressures as applied to said blank during a forming cycle to generate opposing forces to apply initially a very low or substantially nil pressure differential causing compressive force to opposing sides of said blank and then to reduce the cavity side pressure or increase the cover side pressure to permit said blank to be forced toward engagement with said die, and thereafter varying said cavity side or cover side pressure as a function of time while maintaining constant the opposing side pressure in order to create a net differential pressure in accordance with the predetermined pressure-time requirements as necessary to form the blank into the said component shape.

* * * * *